US010532407B2

(12) United States Patent
Kita et al.

(10) Patent No.: US 10,532,407 B2
(45) **Date of Patent: *Jan. 14, 2020**

(54) POROUS COPPER SINTERED MATERIAL, POROUS COPPER COMPOSITE PART, METHOD OF PRODUCING POROUS COPPER SINTERED MATERIAL, AND METHOD OF PRODUCING POROUS COPPER COMPOSITE PART

(71) Applicant: MITSUBISHI MATERIALS CORPORATION, Tokyo (JP)

(72) Inventors: Koichi Kita, Kitamoto (JP); Koji Hoshino, Kitamoto (JP); Toshihiko Saiwai, Kitamoto (JP); Jun Katoh, Kitamoto (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 67 days.

This patent is subject to a terminal disclaimer.

(21) Appl. No.: 15/518,902

(22) PCT Filed: Oct. 21, 2015

(86) PCT No.: PCT/JP2015/079687

§ 371 (c)(1),
(2) Date: Apr. 13, 2017

(87) PCT Pub. No.: WO2016/063905

PCT Pub. Date: Apr. 28, 2016

(65) Prior Publication Data

US 2017/0239729 A1 Aug. 24, 2017

(30) Foreign Application Priority Data

Oct. 22, 2014 (JP) ..... 2014-215339

(51) Int. Cl.
*B32B 15/02* (2006.01)
*B22F 7/00* (2006.01)
(Continued)

(52) U.S. Cl.
CPC ..... *B22F 7/002* (2013.01); *B22F 1/004* (2013.01); *B22F 3/1143* (2013.01);
(Continued)

(58) Field of Classification Search
None
See application file for complete search history.

(56) References Cited

U.S. PATENT DOCUMENTS 2,203,895 A 6/1940 Davis et al.
4,066,450 A 1/1978 Takeuchi et al.
(Continued)

FOREIGN PATENT DOCUMENTS

CN 1133895 A 10/1996
CN 1147030 A 4/1997
(Continued)

OTHER PUBLICATIONS

Office Action dated Jun. 13, 2017, issued for the Japanese Patent Application No. 2016-150199 and English translation thereof.
(Continued)

*Primary Examiner* — Seth Dumbris
(74) *Attorney, Agent, or Firm* — Locke Lord LLP

(57) ABSTRACT

A porous copper sintered material (10) includes: a plurality of copper fibers (11) sintered each other, wherein the copper fibers (11) are made of copper or copper alloy, a diameter R of the copper fibers (11) is in a range of 0.02 mm or more and 1.0 mm or less, and a ratio L/R of a length L of the copper fibers to the diameter R is in a range of 4 or more and 2500 or less (11), redox layers (12) formed by redox treatment are provided on surfaces of copper fibers (11, 11),
(Continued)

and concavities and convexities are formed by the redox layer (12), and each of redox layers (12, 12) formed on each of the copper fibers (11) is integrally bonded in a junction of the copper fibers (11).

3 Claims, 12 Drawing Sheets

(51) Int. Cl.
*B22F 1/00* (2006.01)
*B22F 3/11* (2006.01)

(52) U.S. Cl.
CPC ... *B22F 2201/013* (2013.01); *B22F 2201/016* (2013.01); *B22F 2201/02* (2013.01); *B22F 2201/03* (2013.01); *B22F 2201/10* (2013.01); *B22F 2201/50* (2013.01); *B22F 2998/10* (2013.01)

(56) References Cited

U.S. PATENT DOCUMENTS

| | | | | |
|---|---|---|---|---|
| 5,378,426 | A | 1/1995 | Geibel et al. | |
| 6,616,727 | B1 | 9/2003 | Koyama et al. | |
| 2003/0044301 | A1 | 3/2003 | Lefebvre et al. | |
| 2009/0165651 | A1 | 7/2009 | Burgess et al. | |
| 2013/0305673 | A1* | 11/2013 | Zeller | B01D 39/2034 55/523 |

FOREIGN PATENT DOCUMENTS

| | | | | |
|---|---|---|---|---|
| CN | 1153491 | A | 7/1997 | |
| CN | 101027428 | A | 8/2007 | |
| CN | 101088675 | A | 12/2007 | |
| CN | 102876909 | B | 6/2014 | |
| EP | 0721994 | A2 | 7/1996 | |
| JP | H07-006758 | A | 1/1995 | |
| JP | 08-145592 | A | 6/1996 | |
| JP | 2000192107 | * | 12/1998 | B22F 3/11 |
| JP | 11-217680 | A | 8/1999 | |
| JP | 2000-192107 | A | 7/2000 | |
| JP | 2003-268410 | A | 9/2003 | |
| JP | 2004-218887 | A | 8/2004 | |
| JP | 2009-079766 | A | 4/2009 | |
| JP | 2010-500771 | A | 1/2010 | |
| JP | 2011-111652 | A | 6/2011 | |
| JP | 5166615 | B1 | 3/2013 | |
| JP | 2013-189676 | A | 9/2013 | |
| WO | 2008/019992 | A1 | 2/2008 | |

OTHER PUBLICATIONS

Yong Tang et al., "Feasibility study of porous copper fiber sintered felt: A novel porous flow field in proton exchange membrane fuel cells", International Journal of Hydrogen Energy, Elsevier Science Publishers B.V., Barking, GB, vol. 35, No. 18, Sep. 1, 2010, pp. 9661-9677. (cited in the Jun. 4, 2018 Search Report issued for EP15853350.5).

Search Report dated Jun. 4, 2018, issued for the European patent application No. 15853350.5.

International Search Report dated Jan. 19, 2016, issued for PCT/JP2015/079687 and English translation thereof.

David Chapman: "High Conductivity Copper for Electrical Engineering", Copper Development Association Publication No. 122, May 31, 1998, pp. 1-32. (cited in the May 31, 2019 Office Action issued for EP16807273.4).

Office Action dated May 31, 2019, issued for the European patent application No. 16807273.4.

International Search Report dated Aug. 16, 2016, issued for PCT/JP2016/065122 and English translation thereof. (cited in the related application, U.S. Appl. No. 15/579,668).

Search Report dated Nov. 6, 2018, issued for the European patent application No. 16807272.6. (cited in the related application, U.S. Appl. No. 15/579,668).

Office Action dated Dec. 3, 2018, issued for the Chinese patent application No. 201680024898.3 and English translation thereof. (cited in the related application, U.S. Appl. No. 15/579,668).

International Search Report dated Aug. 16, 2016, issued for PCT/JP2016/065160 and English translation thereof. (U.S. Appl. No. 15/579,688).

H. J. Van Den Hul et al., "Determination of Specific Surface Areas of Dispersed Materials. Comparison of the Negative Adsorption Method with Some Other Methods", Journal of the American Chemical Society, vol. 90, No. 12, Jun. 5, 1968, pp. 3010-3015. (cited in the related application, U.S. Appl. No. 15/579,688).

Ltd First Copper Technology: "Alloy Guide", Jun. 13, 2018, XP055511639,Retrieved from the Internet: URL:http://www.fcht.com.tw/english/AlloyGuideEng.pdf (retrieved on Oct. 2, 2018) (cited in the related application, U.S. Appl. No. 15/579,688).

Search Report dated Oct. 15, 2018, issued for the European patent application No. 16807273.4. (cited in the related application, U.S. Appl. No. 15/579,688).

Office Action dated Oct. 31, 2018, issued for the Chinese patent application No. 201680025074.8 and English translation thereof. (cited in the related application, U.S. Appl. No. 15/579,688).

* cited by examiner

POROUS COPPER SINTERED MATERIAL, POROUS COPPER COMPOSITE PART, METHOD OF PRODUCING POROUS COPPER SINTERED MATERIAL, AND METHOD OF PRODUCING POROUS COPPER COMPOSITE PART

TECHNICAL FIELD

The present invention relates to: a porous copper sintered material made of copper or copper alloy; a porous copper composite part with a main body of the composite part and the porous copper sintered material joined each other; a method of producing the porous copper sintered material; and a method of producing the porous copper composite part.

Priority is claimed on Japanese Patent Application No. 2014-215339, filed Oct. 22, 2014, the content of which is incorporated herein by reference.

BACKGROUND ART

For example, the porous copper sintered material and the porous copper composite part are used as: an electrode and a current collector of various batteries; a part of heat exchangers; a sound-deadening part; a filter; a shock absorbing part; or the like.

For example, a heat-transfer part, in which a porous copper material having a three-dimensional net-like structure is integrally deposited on main body of the part made of conductive metal, is proposed in Patent Literature 1 (PTL 1).

PTL 1 discloses: a method using a formed body in which an adhesive is applied and a metallic powder is deposited on the skeletal structure of the three-dimensional net-like structure made of a material burnt down by heating (such as the synthetic resin form having continuous pores like the urethane form, the polyethylene foam, or the like; the natural fiber cloth; the artificial fiber cloth; and the like); and a method using a formed body in a sheet shape in which a metal powder is impregnated into a material burnt down by heating and capable of forming the three-dimensional net-like structure (for example, pulps and wool fibers), as a method of producing a metal sintered material (porous copper sintered material) having the three-dimensional net-like structure. In this PTL 1, sintering is performed in a reducing atmosphere.

CITATION LIST

Patent Literature

PTL 1: Japanese Unexamined Patent Application, First Publication No. H08-145592 (A)

SUMMARY OF INVENTION

Technical Problem

There is a technical problem that a porous copper sintered material having a high porosity is hard to obtain because of a high shrinkage ratio in sintering, when the metallic sintered material (porous copper sintered material) is formed by using the metal powder as described in PTL 1.

In addition, in the metallic sintered material (porous copper sintered material) described in PTL 1, the surface of the metal powder is a relatively flat and smooth surface; and a sufficient joining area between each grain of the metal powder cannot be obtained, since sintering is simply performed in a reducing atmosphere. Thus, there is a technical problem that a sufficient sinter strength cannot be ensured. Because of the insufficient sinter strength, there is a possibility that various characteristics such as the heat transfer characteristics, the conductivity, and the like as the metallic sintered material (porous copper sintered material) could be deteriorated.

Moreover, when the metallic sintered material (porous copper sintered material) is formed by utilizing the three-dimensional net-like structure made of material burnt down by heating, the formed body becomes deformed during the three-dimensional net-like structure being burnt down before sintering progresses. Thus, there is a possibility that the metallic sintered material (porous copper sintered material) having an excellent dimensional accuracy could not manufactured.

The present invention is made under the circumstances described above. The purpose of the present invention is to provide: a porous copper sintered material having a low shrinkage ratio in sintering, an excellent dimensional accuracy, and a sufficient strength; a porous copper composite part in which this porous copper sintered material is joined to a main body of the composite part; a method of producing the porous copper sintered material; and a method of producing the porous copper composite part.

Solution to Problem

By solving the above-described technical problems to achieve the purpose, the present invention has aspects below. An aspect of the present invention is a porous copper sintered material including a plurality of copper fibers sintered each other, wherein the copper fibers are made of copper or copper alloy, a diameter R of the copper fibers is in a range of 0.02 mm or more and 1.0 mm or less, and a ratio L/R of a length L of the copper fibers to the diameter R is in a range of 4 or more and 2500 or less, redox layers formed by redox treatment are provided on surfaces of copper fibers, and concavities and convexities are formed by the redox layer, and each of redox layers formed on each of the copper fibers is integrally bonded in a junction of the copper fibers.

According to the pours copper sintered material as configured above, a sufficient space is secured between each of the copper fibers; the shrinkage ratio in sintering is kept at a low value; and a high porosity and an excellent dimensional accuracy are obtained, since it is configured by sintering each of the copper fibers having the diameter R in a range of 0.02 mm or more and 1.0 mm or less and the ratio L/R in the range of 4 or more and 2500 or less.

In addition, the redox layers exist on the surfaces of the copper fibers; and the concavities and convexities are formed by the redox layers. In the junction between each of copper fibers, each of the redox layers formed on each surface is integrally bonded. Therefore, the joining area is secured for the each of the copper fibers to be joined each other strongly; and the strength of the porous copper sintered material is further improved.

In addition, the surface area becomes larger since the fine concavities and convexities are formed on the surfaces of the copper fibers by the redox layers. Thus, various characteristics such as the heat exchange efficiency and the water retentivity can be improved significantly, for example.

Other aspect of the present invention is a porous copper composite part including a main body of the composite part and the above-described porous copper sintered material, wherein the main body of the composite part and the porous copper sintered material are joined.

According to the porous copper composite part configured as described above, the above-described porous copper sintered material, which has a high porosity, and excellent dimensional accuracy and strength, is joined to the main body of the composite part strongly. Therefore, as a porous copper composite part, the porous copper composite part exhibits various characteristics such as excellent heat transfer characteristics, conductivity, and the like, in addition to the characteristics of the porous copper sintered material alone, which has a large surface area and various excellent characteristics such as the heat exchange efficiency and water retentivity.

In the above-described porous copper composite part, among the main body of the composite part, a joining surface of the main body of the composite part joined to the porous copper sintered material may be constituted of copper or copper alloy, a redox layer formed by redox treatment may be provided on the joining surface of the main body of the composite part, and the redox layer formed on the surfaces of the copper fibers and the redox layer formed on the joining surface of the main body of the composite part may be integrally bonded in junctions between the copper fibers constituting the porous copper sintered material and the joining surface of the main body of the composite part.

In this case, the redox layers formed by the redox treatment exist on the joining surface of the main body of the composite part; and the redox layers formed on the surfaces of the copper fibers and the redox layer formed on the joining surface of the main body of the composite part are integrally bonded in the junctions between the copper fibers constituting the porous copper sintered material and the joining surface of the main body of the composite part. Therefore, the porous copper sintered material and the main body of the composite part are strongly joined; and the porous copper composite part exhibits various characteristics such as an excellent strength as the porous copper composite part, excellent heat exchange characteristics and conductivity, and the like.

Other aspect of the present invention is a method of producing a porous copper sintered material having a plurality of copper fibers sintered each other: the copper fibers being made of copper or copper alloy; a diameter R of the copper fibers being in a range of 0.02 mm or more and 1.0 mm or less; a ratio L/R of a length of the copper fibers to the diameter R being 4 or more and 2500 or less; the method including the steps of: laminating the plurality of copper fibers; and sintering the laminated copper fibers each other, wherein the plurality of copper fibers are laminated in such a way that a bulk density $D_P$ becomes 50% or less of a true density $D_T$ of the copper fibers in the step of laminating the plurality of copper fibers, and after oxidizing each of the copper fibers, the oxidized copper fibers are reduced and the copper fibers are bonded each other in the step of sintering.

According to the method of producing a porous copper sintered material configured as described above, spaces are secured between each of the copper fibers since the method includes the step of laminating the copper fibers, which has the diameter R in the range of 0.02 mm or more and 1.0 mm or less and the ratio L/R of the length L to the diameter R in the range of 4 or more and 2500 or less, in such a way that the bulk density $D_P$ becomes 50% or less of the true density $D_T$ of the copper fibers. In addition, the shrinkage ratio in sintering, which is change of the form, can be suppressed since the number of the sintering points is significantly reduced compared to sintering of each of powders. As a result, a porous copper sintered material having a high porosity and a high dimensional accuracy can be obtained.

The method is configured that after oxidizing the copper fibers, the oxidized copper fibers are reduced; and the copper fibers are bonded each other in the step of sintering. Thus, the redox layers are formed on the surfaces of the copper fibers for the fine concavities and convexities to be formed. Each of copper fibers is joined through the redox layers. Therefore, the strength of the porous copper sintered material can be improved.

Other aspect of the present invention is a method of producing a porous copper composite part having a main body and a porous copper sintered material joined each other, the method including the step of joining: the porous copper sintered material produced by the above-described method of producing a porous copper sintered material; and the main body of the composite part.

In the method of producing a porous copper composite part configured as described above, the porous copper composite part having various excellent characteristics such as the heat transfer characteristics, conductivity, and the like can be produced, since it has the porous copper sintered material equivalent to the porous copper sintered material, which is produced by the above-described method of producing a porous copper sintered material and has a high porosity and excellent strength.

In the method of producing the porous copper composite part of the present invention, among the main body of the composite part, a joining surface of the main body joined to the porous copper sintered material may be constituted of copper or copper alloy, the plurality of copper fibers may be laminated on the joining surface of the main body in the step of laminating the plurality of copper fiber, and after oxidizing the copper fibers and the joining surface of the main body, the oxidized copper fibers and the joining surface of the main body may be reduced; and each of the copper fibers may be bonded; and the copper fibers and the joining surface of the main body may be bonded in the steps of sintering and joining.

In this case, the step of sintering, in which the porous copper sintered material is obtained by bonding each of the copper fibers, and the step of joining, in which the copper fibers and the main body of the composite part are bonded, can be performed concurrently. Thus, the production process can be simplified.

In addition, the method is configured that after oxidizing the copper fibers and the joining surface of the main body, the oxidized copper fibers and the joining surface of the main body are reduced; and each of the copper fibers is bonded; and the copper fibers and the joining surface of the main body are bonded in the step of sintering and the step of joining. Thus, both of: the joining strength between each of the copper fibers; and the joining strength between the copper fibers (porous copper sintered material) and the main body of the composite part, can be improved.

Moreover, the porous copper composite part having various excellent characteristics such as the heat transfer characteristics, the conductivity, and the like can be produced, since the main body of the composite part and the porous copper sintered material are joined strongly.

Advantageous Effects of Invention

According to the present invention, a porous copper sintered material having a low shrinkage ratio in sintering, an excellent dimensional accuracy, and a sufficient strength; a porous copper composite part in which this porous copper sintered material is joined to a main body of the composite part; a method of producing the porous copper sintered material; and a method of producing the porous copper composite part, can be provided.

DESCRIPTION OF EMBODIMENTS

The porous copper sintered material and the porous copper composite part, both of which are embodiments of the present invention, are explained below in reference to the attached drawings.

First Embodiment

First, the porous copper sintered material 10 and the method of producing the porous copper sintered material 10, both of which are the first embodiment of the present invention, are explained in reference to FIGS. 1 to 6B.

Figure 1:
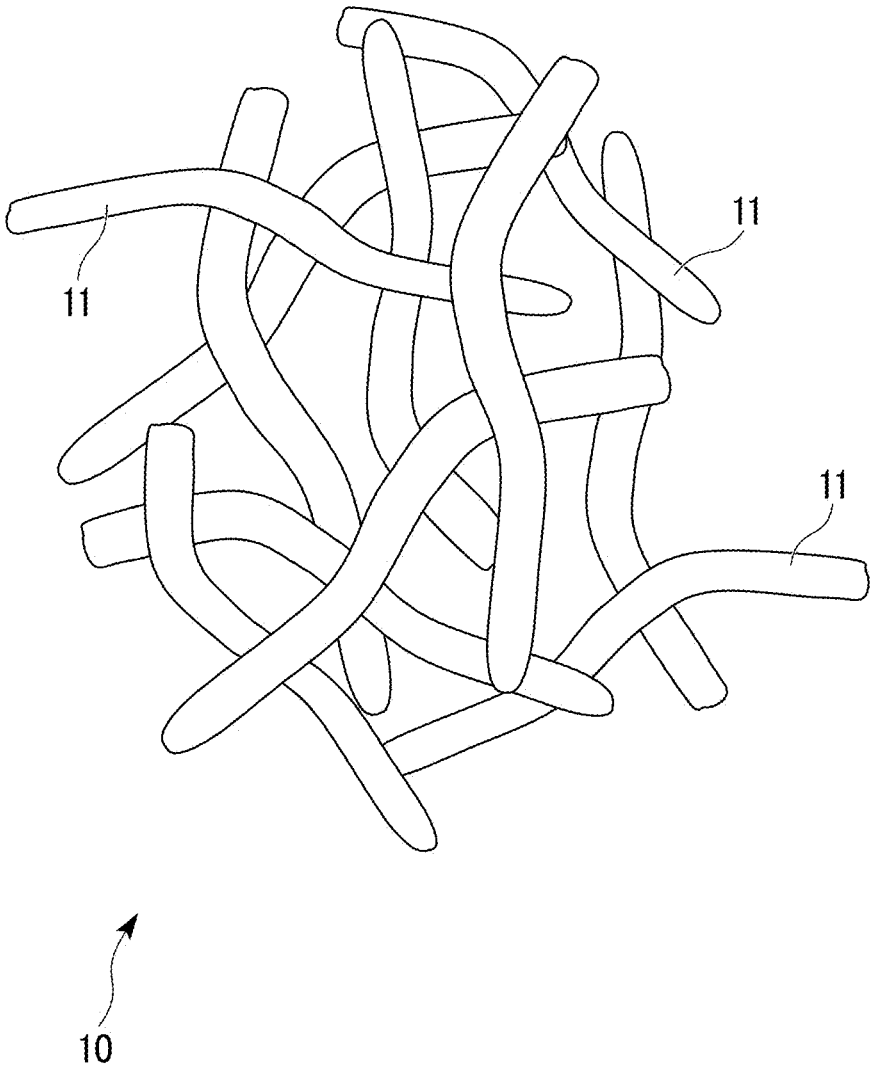
FIG. 1 is an enlarged schematic view of a porous copper sintered material according to the first embodiment of the present invention.

The porous copper sintered material 10 of the present embodiment is made of multiple copper fibers 11 integrally sintered as shown in FIG. 1.

The copper fibers 11 are made of copper or copper alloy. The diameter R of the copper fibers 11 is in the range of 0.02 mm or more and 1.0 mm or less; and the ratio L/R of the length L and the diameter R is in the range of 4 or more and 2500 or less. For example, the copper fibers 11 are made of C1100 (the tough pitch copper) in the present embodiment.

In the present embodiment, shaping such as twisting, bending, and the like is applied on the copper fibers 11.

In addition, the apparent density $D_A$ is set to 51% or less of the true density $D_T$ of the copper fibers 11 in the porous copper sintered material 10 of the present embodiment. Any shape such as the straight shape, the curved shape, and the like can be chosen as the shape of the copper fibers 11, as long as the apparent $D_A$ becomes 51% or less of the true density $D_T$ of the copper fibers 11. By using fibers subjected to a shaping process such as twisting, bending and the like into a predetermined shape as at least a part of the copper fibers 11, the shape of the space between each of fibers can be formed sterically and isotropically. As a result, isotropy of the various characteristics of the porous copper sintered material such as the heat transfer characteristics, the conductivity, and the like is improved.

Figure 2:
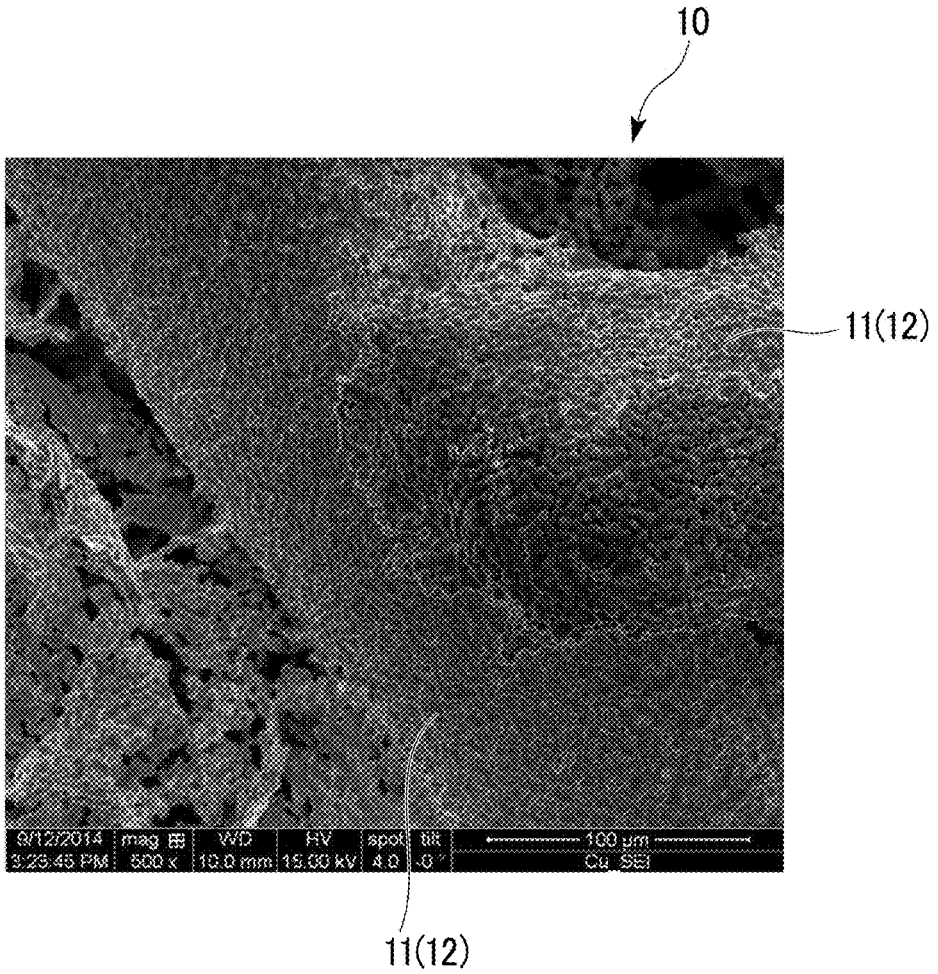
FIG. 2 is an observation photograph showing the bonding state of copper fibers constituting the porous copper sintered material shown in FIG. 1.
Figure 3:
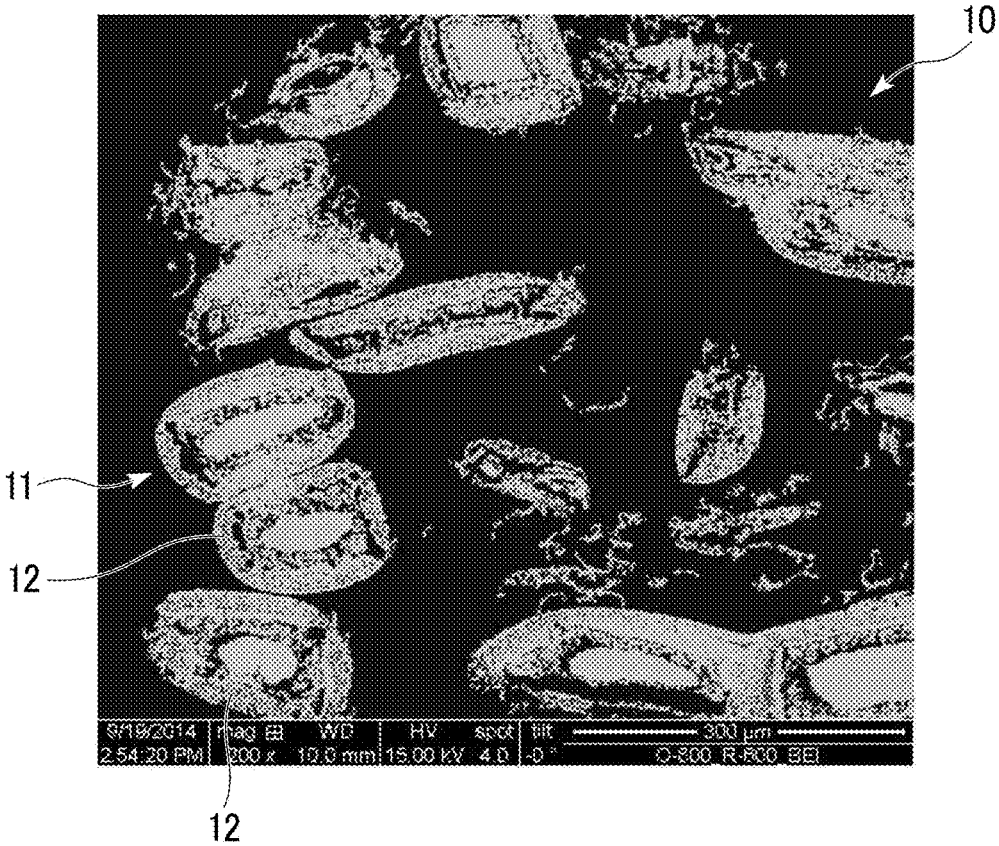
FIG. 3 is a cross-sectional observation photograph of the bonding of copper fibers constituting the porous copper sintered material shown in FIG. 1.

The redox layers 12 are formed on the surfaces of the copper fibers 11; and each of the redox layers 12 formed on each of the copper fibers 11, 11 is integrally bonded in the junctions between each of the copper fibers 11, 11, in the porous copper sintered material 10 of the present embodiment as shown in FIGS. 2 and 3.

The redox layer 12 is in the porous structure as shown in FIG. 3. Fine concavities and convexities are formed on the surfaces of the copper fibers 11 as shown in FIG. 2.

Figure 4:
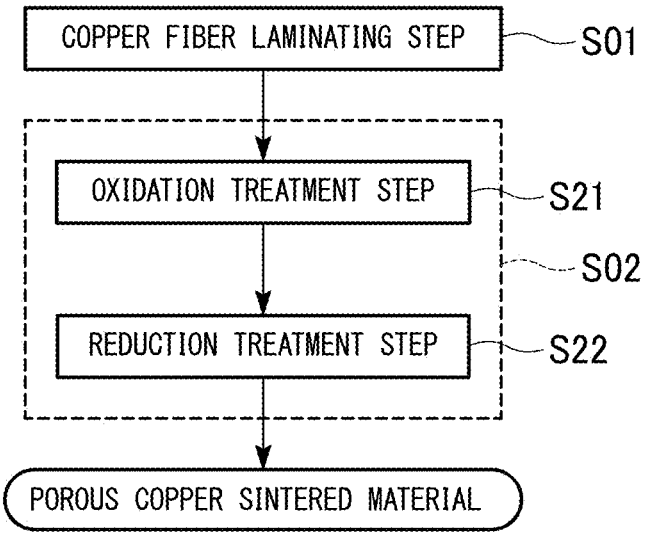
FIG. 4 is a flow chart showing an example of the method of producing the porous copper sintered material shown in FIG. 1.
Figure 5:
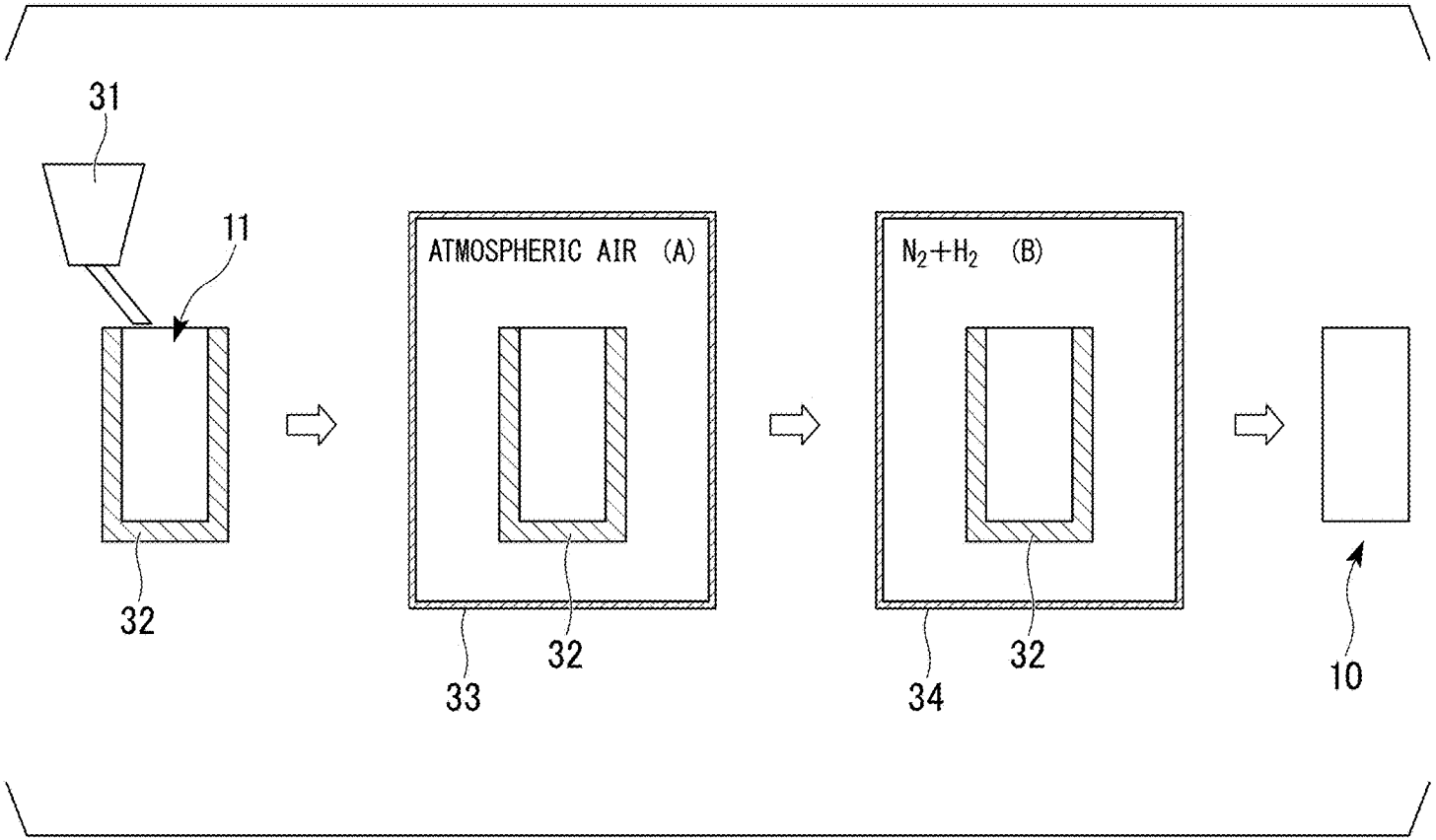
FIG. 5 is an explanatory view showing a manufacturing process for producing the porous copper sintered material shown in FIG. 1.
Figure 6A:
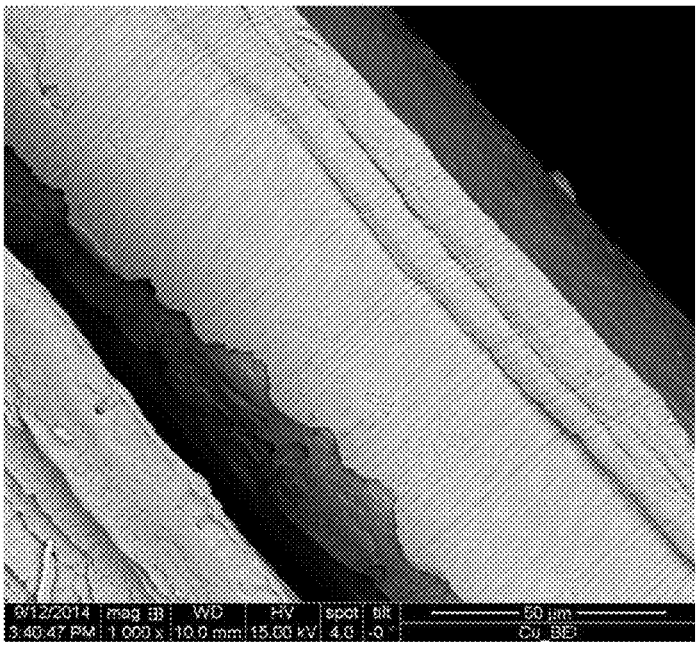
FIG. 6A is an observation photograph of copper fibers constituting the porous copper sintered material shown in FIG. 1, and is an observation photograph of the copper fibers before the step of sintering (the oxidation treatment step and the reduction treatment step).
Figure 6B:
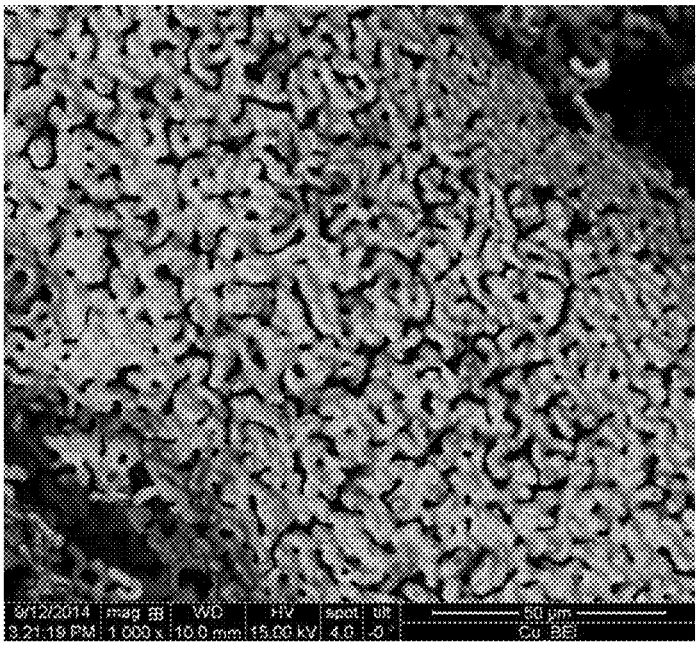
FIG. 6B is an observation photograph of copper fibers constituting the porous copper sintered material shown in FIG. 1, and is an observation photograph of the copper fibers after the step of sintering (the oxidation treatment step and the reduction treatment step).

Next, the method of producing the porous copper sintered material 10 of the present embodiment is explained in reference to the flow chart shown in FIG. 4, the drawing of the manufacturing process shown in FIG. 5, and the like.

First, the raw material of the porous copper sintered material 10 of the present embodiment and the copper fibers 11 are sprayed toward the inside of the container 32 made of stainless from the sprayer 31 to bulk-fill; and the copper fibers 11 are laminated as shown in FIG. 5 (the copper fiber laminating step S01). In this laminating copper fiber step S01, multiple copper fibers 11 are laminated in such a way that the bulk density $D_P$ after the above-described filling becomes 50% or less of the true density $D_T$ of the copper fibers 11. In the present embodiment, the space between each of the copper fibers 11 is secured sterically and isotropically in laminating, since the copper fibers 11 are subjected to shaping process such as twisting, bending and the like.

Next, the bulk filled copper fibers 11 in the container 32 made of stainless are sintered (the sintering step S02). As shown in FIGS. 4 and 5, the step of sintering S02 includes the oxidation treatment step S21, in which the oxidation treatment on the copper fibers 11 is performed, and the reduction treatment step S22, in which the oxidization-treated copper fibers 11 is reduced and sintered.

The container 32 made of stainless and filled with the copper fibers 11 is inserted in the heating furnace 33; and the copper fibers 11 are subjected to the oxidation treatment by heating in the air atmosphere A, in the present embodiment as shown in FIG. 5 (the oxidation treatment step S21). By performing the oxidation treatment step S21, the oxide layers having 1 μm or more and 100 μm or less of the thickness, for example, are formed on the surfaces of the copper fibers 11.

In the condition of the oxidation treatment step S21 in the present embodiment, the retention temperature is set in the range of 520° C. or more and 1050° C. or less; and the retention time is set in the range of 5 minutes or more and 300 minutes or less.

If the retention temperature in the oxidation treatment step S21 were less than 520° C., it would be possible that the oxide layers are not formed sufficiently on the surfaces of the copper fibers 11. On the other hand, if the retention temperature in the oxidation treatment step S21 exceeded 1050° C., it would be possible that the copper (II) oxide formed by oxidation is decomposed.

Because of the reasons described above, the retention temperature in the oxidation treatment step S21 is set to 520° C. or more and 1050° C. or less in the present embodiment. In order to reliably form the oxide layers on the surfaces of the copper fibers 11, it is preferable that the lower limit of the retention temperature is set to 600° C. or more; and the upper limit of the retention temperature is set to 1000° C. or less in the oxidation treatment step S21

If the retention time were less than 5 minutes in the oxidation treatment step S21, it would be possible that the oxide layers are not formed sufficiently on the surfaces of the copper fibers 11. On the other hand, if the retention time in the oxidation treatment step S21 exceeded 300 minutes, oxidation would proceed to the insides of the copper fibers 11; and it would be possible that the copper fibers 11 become embrittle for strength to be reduced.

Because of the reasons described above, the retention time in the oxidation treatment step S21 is set to 5 minutes or more and 300 minutes or less in the present embodiment. In order to reliably form the oxide layers on the surfaces of the copper fibers 11, it is preferable that the lower limit of the retention time is set to 10 minutes or more in the oxidation treatment step S21. In addition, in order to reliably suppress the embrittlement of the copper fibers 11 due to excessive oxidation, it is preferable that the upper limit of the retention time is set to 100 minutes or less in the oxidation treatment step S21.

Next, the container 32 made of stainless and filled with the copper fibers 11 is inserted in the firing furnace 34 after performing the oxidation treatment step S21; and the oxidized copper fibers 11 are reduced and the copper fibers 11 are bonded each other by heating in the reducing atmosphere, in the present embodiment as shown in FIG. 5 (the reduction treatment step S22).

In the condition of the reduction treatment step S22 in the present embodiment, the atmosphere is the mixed gas atmosphere B of nitrogen and hydrogen; the retention temperature is set in the range of 600° C. or more and 1080° C. or less; and the retention time is set in the range of 5 minutes or more and 300 minutes or less.

If the retention temperature in the reduction treatment step S22 were less than 600° C., it would be possible that the oxide layers formed on the surfaces of the copper fibers 11 are not reduced sufficiently. On the other hand, if the retention temperature in the reduction treatment step S22 exceeded 1080° C., the copper fibers 11 would be heated to the temperature close to the melting point of copper; and it would be possible that strength and porosity are reduced.

Because of the reasons described above, the retention temperature in the reduction treatment step S22 is set to 600° C. or more and 1080° C. or less in the present embodiment. In order to reliably reduce the oxide layers formed on the surfaces of the copper fibers 11, it is preferable that the lower limit of the retention temperature is set to 650° C. or more in the reduction treatment step S22. In addition, in order to reliably suppress the reduction of strength and porosity, it is preferable that the upper limit of the retention temperature is set to 1050° C. or less in the reduction treatment step S22.

If the retention time were less than 5 minutes in the reduction treatment step S22, it would be possible that the oxide layers formed on the surfaces of the copper fibers 11 are not reduced sufficiently and the copper fibers 11 are not sintered sufficiently. On the other hand, if the retention time in the reduction treatment step S22 exceeded 300 minutes, it would be possible that the thermal shrinkage by sintering becomes a larger value; and the strength is reduced.

Because of the reasons described above, the retention time in the reduction treatment step S22 is set to 5 minutes or more and 300 minutes or less in the present embodiment. In order to reliably reduce the oxide layers formed on the surfaces of the copper fibers 11 and allow sintering proceed sufficiently, it is preferable that the lower limit of the retention time is set to 10 minutes or more in the reduction treatment step S22. In addition, in order to reliably suppress the thermal shrinkage and reduction of strength by sintering, it is preferable that the upper limit of the retention time is set to 100 minutes or less in the reduction treatment step S22.

By performing the oxidation treatment step S21 and the reduction treatment step S22, the redox layers 12 are formed on the surfaces of the copper fibers; and the fine concavities and convexities are formed as shown in FIGS. 2, 3, 6A and 6B. In addition, by the oxidation treatment step S21, the oxide layers are formed on the surfaces of the copper fibers 11; and each of multiple copper fibers are cross-lined by the oxide layer. After the oxidation treatment step S21, by performing the reduction treatment step S22, the above-described oxide layers formed on the surfaces of the copper fibers 11 are reduced; the above-described redox layers 12 are formed; and each of the redox layers 12 is bonded each other, thereby each of the copper fibers is sintered.

By the production method as explained above, the porous copper sintered material 10 of the present embodiment is produced.

According to the porous copper sintered material 10 of the present embodiment as configured above, a sufficient space between each of the copper fibers 11 is secured; the shrinkage ratio in sintering is suppressed; the porosity is high; and the dimensional accuracy is excellent, since the porous copper sintered material 10 is composed by sintering the copper fibers 11 having the diameter R in the range of 0.02 mm or more and 1.0 mm or less, and the ratio L/R of the Length L to the diameter R in the range of 4 or more and 2500 or less.

In addition, in the porous copper sintered material 10 of the present embodiment, each of the copper fibers 11 is joined by each of the oxide layers 12 formed on each of the surfaces of the fibers being integrally bonded.

In addition, according to the method of producing the porous copper sintered material 10 of the present embodiment, the space between each of the copper fibers 11 is secured; and shrinkage is suppressed in the sintering step S02, since the method includes the laminating step of the copper fibers S01, in which the copper fibers 11 having the diameter R in the range of 0.02 mm or more and 1.0 mm or less, and the ratio L/R of the Length L to the diameter R in the range of 4 or more and 2500 or less are laminated in such a way that the bulk density $D_P$ becomes 50% or less of the true density $D_T$ of the copper fibers. Because of this, the porous copper sintered material 10 having a high porosity and an excellent dimensional accuracy can be produced.

Specifically, the apparent density $D_A$ of the porous copper sintered material 10, which is produced by sintering the copper fibers 11 laminated in such a way that the bulk density $D_P$ becomes 50% or less of the true density $D_T$ of the copper fibers, is set to 51% or less of the true density $D_T$ of the copper fibers 11. Therefore, shrinkage in the sintering step S02 is suppressed; and the high porosity can be secured.

If the diameter R of the copper fibers 11 were less than 0.02 mm, the joining area between each of the copper fibers 11 would be too less; and it would be possible that the sintering strength would be insufficient. On the other hand, if the diameter R of the copper fibers 11 exceeded 1.0 mm, the number of the contacting points between each of the copper fibers 11 would be insufficient; and it would be possible that the sintering strength would be insufficient, similarly.

Because of these, the diameter R of the copper fibers 11 is set in the range of 0.02 mm or more and 1.0 mm or less in the present embodiment. In order to obtain additional improvement in strength, it is preferable that the lower limit of the diameter R of the copper fibers 11 is set to 0.05 mm or more; and the upper limit of the diameter R of the copper fibers 11 is set to 0.5 mm or less.

If the ratio L/R of the length L to the diameter R of the copper fibers 11 were less than 4, it would be hard to set the bulk density $D_P$ to 50% or less of the true density $D_T$ in layering the copper fibers 11; and it would be possible that obtaining the porous copper sintered material 10 having the high porosity becomes difficult. On the other hand, if the ratio L/R of the length L to the diameter R of the copper fibers 11 exceeded 2500, the copper fibers 11 would not be dispersed uniformly; and it would be possible that obtaining the porous copper sintered material 10 having a uniform porosity becomes difficult.

Because of these, the ratio L/R of the length L to the diameter R of the copper fibers 11 is set in the range of 4 or more and 2500 or less in the present embodiment. In order to obtain additional improvement in the porosity, it is preferable that the lower limit of the ratio L/R of the length L to the diameter R of the copper fibers 11 is set to 10 or more. In order to reliably obtain the porous copper sintered material 10 having the uniform porosity, it is preferable that the upper limit of the ratio L/R of the length L to the diameter R of the copper fibers 11 is set to 500 or less.

In addition, each of the copper fibers 11 is joined each other strongly in the sintering step S02 since the sintering step S02 includes the oxidation treatment step S21, in which the copper fibers 11 are oxidized, and the reduction treatment step S22, in which the oxidized copper fibers 11 are reduced and the each of the reduced copper fibers 11 is bonded. In the present embodiment, the redox layers 12 are formed on the surfaces of the copper fibers 11 by reducing the copper fibers 11 after performing the oxidization treatment, and fine concavities and convexities are formed as shown in FIGS. 2, 3, 6A and 6B. In the junctions between each of the copper fibers 11, each of the redox layers 12 is integrally bonded. Therefore, the joining area can be secured; and each of the copper fibers 11 can be bonded strongly.

In addition, in the porous copper sintered material 10 of the present embodiment, the concavities and convexities are formed on the surfaces of the copper fibers 11; and the surface area is increased. Therefore, various characteristics such as heat exchange efficiency, water retentivity, and the like can be improved significantly.

Second Embodiment

Next, the porous copper composite part 100, which is the second embodiment of the present invention, is explained in reference to the attached drawings.

Figure 7:
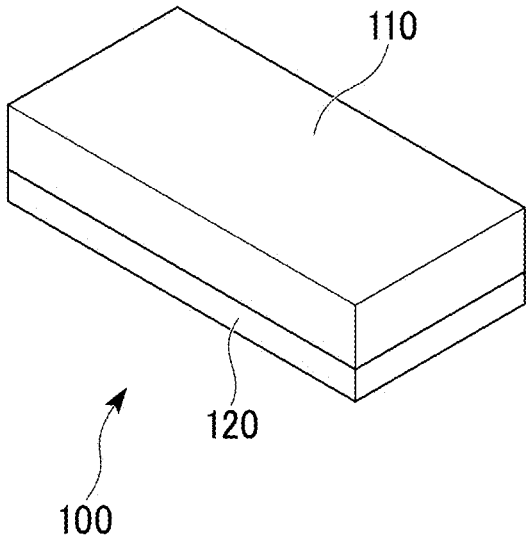
FIG. 7 is an external explanatory view of a porous copper composite part according to the second embodiment of the present invention.

The porous copper composite part 100 of the present embodiment is shown in FIG. 7. The porous copper composite part 100 of the present embodiment includes: the copper plate 120 (main body of the composite part) made of copper or copper alloy; and the porous copper sintered material 110 joined to the surface of the copper plate 120.

The porous copper sintered material 110 in the present embodiment is one made of multiple copper fibers 11 integrally sintered as in the first embodiment. The copper fibers are made of copper or copper alloy. The diameter R of the copper fibers is in the range of 0.02 mm or more and 1.0 mm or less; and the ratio L/R of the length L and the diameter R is in the range of 4 or more and 2500 or less. For example, the copper fibers are made of C1100 (the tough pitch copper) in the present embodiment.

In the present embodiment, shaping such as twisting, bending, and the like is applied on the copper fibers. In addition, the apparent density $D_A$ is set to 51% or less of the true density $D_T$ of the copper fibers 11 in the porous copper sintered material 110 of the present embodiment.

In addition, the redox layers are formed on the surfaces of the copper fibers constituting the porous copper sintered material 110 and the surface of the copper plate 120 by performing the oxidation treatment and the reduction treatment as explained later in the present embodiment. Because of this, fine concavities and convexities are formed on the surfaces of the copper fibers and the copper plate 120.

In the junctions between the surfaces of the copper fibers constituting the porous copper sintered material 110 and the surface of the copper plate 120, the redox layers formed on the surfaces of the copper fibers and the redox layer formed on the copper plate are bonded integrally.

Figure 8:
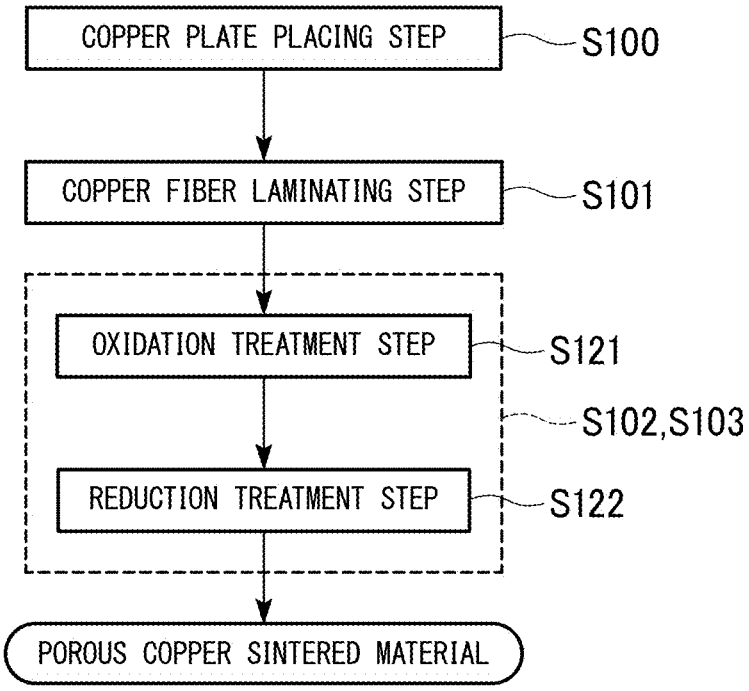
FIG. 8 is a flow chart showing an example of the method of producing the porous copper composite part shown in FIG. 7.

Next, the method of producing the porous copper composite part of the present embodiment is explained in reference to the flow chart shown in FIG. 8.

First, the copper plate 120, which is the main body of the composite part, is prepared (the copper plate placing step S100). Next, the copper fibers are dispersedly laminated on the surface of the copper plate 120 (the copper fiber laminating step S101). In the copper fiber laminating step S101, multiple copper fibers are laminated in such a way that the bulk density $D_P$ becomes 50% or less of the true density $D_T$ of the copper fibers 11.

Next, by sintering each of the copper fibers laminated on the surface of the copper plate 120, the porous copper sintered material 110 is formed; and the porous copper sintered material 110 (copper fibers) and the copper plate are bonded (the sintering step S102 and the joining step S103). As shown in FIG. 8, the sintering step S102 and the joining step S103 includes the oxidation treatment step S121, in which oxidation treatment is performed on the copper fibers and the copper plates, and the reduction treatment step S122, in which the reducing and sintering of the oxidized copper fibers and the copper plate 120 are performed.

The oxidation treatment of the copper fibers is performed by inserting the copper plate 120, on which the copper fibers are laminated, in the heating furnace; and by heating the copper plate 120 in the air atmosphere A, in the present embodiment (the oxidation treatment step S121). By performing the oxidation treatment step S121, the oxide layers having 1 μm or more and 100 μm or less of the thickness, for example, are formed on the surfaces of the surfaces of the copper fibers and the copper plate 120.

In the condition of the oxidation treatment step S121 in the present embodiment, the retention temperature is set in the range of 520° C. or more and 1050° C. or less, preferably in the range of 600° C. or more and 100° C. or less; and the retention time is set in the range of 5 minutes or more and 300 minutes or less, preferably in the range of 10 minutes or more and 100 minutes or less.

Next, the copper plate 120, on which the copper fibers are laminated, is inserted in the firing furnace after performing the oxidation step S121; the oxidized copper fibers and the copper plates are reduced by heating in the reduction atmosphere; each of copper fibers is bonded; and the copper fibers and the copper plate are bonded, in the present embodiment (the reduction treatment step S122).

In the condition of the reduction treatment step S122 in the present embodiment, the atmosphere is the mixed gas atmosphere B of nitrogen and hydrogen; the retention temperature is set in the range of 600° C. or more and 1080° C. or less, preferably in the range of 650° C. or more and 1050° C. or less; and the retention time is set in the range of 5 minutes or more and 300 minutes or less, preferably in the range of 10 minutes or more and 100 minutes or less.

By performing the oxidation treatment step S121 and the reduction treatment step S122, the redox layers are formed on the surfaces of the copper fibers and the copper plate 120; and the fine concavities and convexities are formed.

In addition, by the oxidation treatment step S121, the oxide layers are formed on the surfaces of the copper fibers and the copper plate; and each of multiple copper fibers and the copper plate are cross-lined by the oxide layer. After the oxidation treatment step S121, by performing the reduction treatment step S122, the above-described oxide layers formed on the surfaces of the copper fibers and the copper plate are reduced; each of the copper fibers are sintered and the copper fibers and the copper plate are bonded through the redox layers.

By the production method as explained above, the porous copper composite part 100 of the present embodiment is produced.

According to the porous copper composite part 100 of the present embodiment as configured above, the porous copper sintered material 110, which is made of sintered the copper fibers having the diameter R in the range of 0.02 mm or more and 1.0 mm or less and the ratio L/R of the length L of the copper fiber and the diameter R in the range of 4 or more and 2500 or less; has a high porosity; and has excellent strength and dimensional accuracy, is jointed to the surface of the copper plate 120. Thus, the porous copper composite part 100 excels in various characteristics such as the heat transfer characteristics, the conductivity, and the like In addition, the redox layers are formed on the surfaces of the copper fibers constituting the porous copper sintered material 110 and the copper plate 120 in the present embodiment. Thus, the redox layers formed on the surfaces of the copper fibers and the redox layer formed on the surface of the copper plate 120 are integrally bonded in the junctions between the copper fibers constituting the copper porous sintered material 110 and the surface of the copper plate 120. Therefore, the porous copper sintered material 110 and the copper plate 120 are joined strongly. Thus, the porous copper composite part 100 excels in various characteristics such as the strength in the junction interfaces the heat transfer characteristics, the conductivity, and the like.

In addition, fine concavities and convexities are formed on the surfaces of the copper fibers and the copper plate by the above-described redox layers. Thus, joining area is secured in the joints between the copper fibers constituting the porous copper sintered material 110 and the surface of the copper plate 120. Therefore, the joining strength between the porous copper sintered material 110 and the copper plate 120 can be improved.

According to the method of producing the porous copper composite part 100 of the present embodiment, the space between each of the copper fibers is secured; and shrinkage is suppressed in the sintering step S102, since the method includes the laminating step of the copper fibers S101, in which the copper fibers having the diameter R in the range of 0.02 mm or more and 1.0 mm or less, and the ratio L/R of the Length L to the diameter R in the range of 4 or more and 2500 or less are laminated on the surface of the copper plate 120 in such a way that the bulk density $D_P$ becomes 50% or less of the true density $D_T$ of the copper fibers. Because of this, the porous copper sintered material 110 having a high porosity and an excellent dimensional accuracy can be produced. As a result, the porous copper composite part 100 having various excellent characteristics such as the heat transfer characteristics, the conductivity, and the like can be produced.

In addition, in the method of producing the porous copper composite part 100 of the present embodiment, the copper fibers are laminated on the surface of the copper plate 120 made of copper or copper alloy; and the sintering step S102 and the joining step S103 are performed concurrently. Thus, the production process can be simplified.

In addition, in the present embodiment, it is configured that the oxidized surfaces of the copper fibers and the copper plate are reduced after oxidizing the surfaces of the copper fibers and the copper plate 120; each of the copper fibers is bonded; and the copper fibers and the surface of the copper plate 120 are bonded, in the sintering step S102 and the joining step S103. Thus, the sintering strength between each of the copper fibers and the joining strength between the copper fibers (the porous copper sintered material 110) and the copper plate 120 can be improved. The redox layers are formed on the surfaces of the copper fibers and the copper plate; and fine concavities and convexities are formed, by reducing them after performing the oxidation treatment on the surfaces of the copper fibers and the copper plate 120 in the present embodiment. Thus, joining area is secured; and the each of the copper fibers, and the copper fibers and the copper plate 120 can be bonded strongly.

Embodiments of the present invention are explained above. However, the present invention is not limited by the descriptions of the embodiments. The present invention can be modified as needed without deviating from the scope of the present invention.

For example, it is explained that the porous copper sintered material is produce by using the manufacturing facility shown in FIG. 5. However, the present invention is not limited by the description, and the porous copper sintered material may be produced by using other manufacturing facility.

In terms of the atmosphere in the oxidation treatment steps S21, S121 of the sintering steps S02, S102; the joining step S103, any atmosphere can be chosen as long as the atmosphere is an oxidizing atmosphere in which the copper or the copper alloy is oxidized in the predetermined temperature. Specifically, not only the air atmosphere but an atmosphere of an inert gas (nitrogen, for example) including 10 volume % or more of oxygen may be used. In addition, in terms of the atmosphere in the reduction treatment steps S22, S122, any atmosphere can be chosen as long as the atmosphere is an reducing atmosphere, in which the copper oxide is reduced to metallic copper or the copper oxide is decomposed, in the predetermined temperature. Specifically, any one of a nitrogen-hydrogen mixed gas, an argon-hydrogen mixed gas, a pure hydrogen gas, an industrially well-used ammonia decomposition gas, a propane decomposition gas; and the like, each of which includes several volume % or more of hydrogen, may be suitably used.

In addition, the porous copper composite part is explained by using the structure of the example shown in FIG. 7 in the second embodiment. However, the present invention is not limited by the description. The porous copper composite part may be in one of the structures shown in FIGS. 9 to 14.

Figure 9:
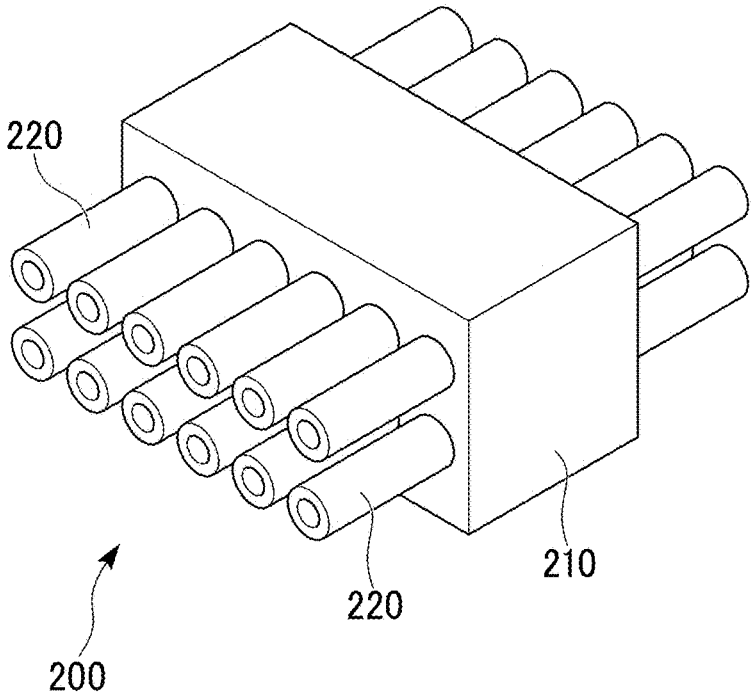
FIG. 9 is an external view of a porous copper composite part according to another embodiment of the present invention.

For example, as shown in FIG. 9, the porous copper composite part may be the porous copper composite part 200 having the structure, in which multiple copper tubes 220 are inserted into the porous copper sintered material 210 as the main body of the composite part.

Figure 10:
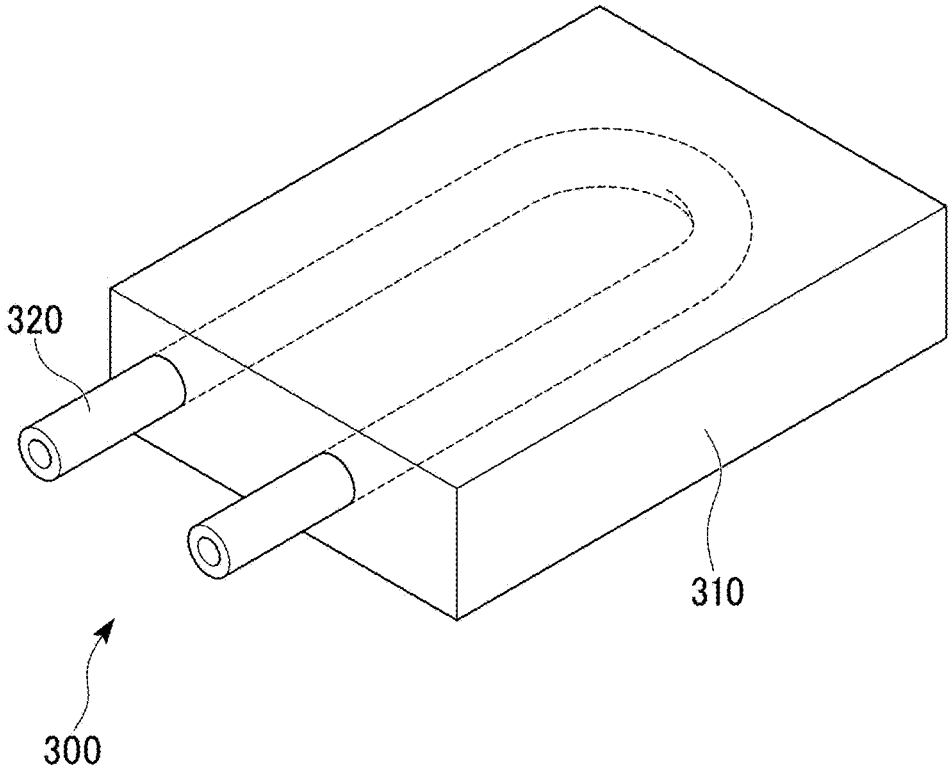
FIG. 10 is an external view of a porous copper composite part according to another embodiment of the present invention.

Alternatively, as shown in FIG. 10, the porous copper composite part may the porous copper composite part 300 having the structure in which the copper tube 320 curved in the U-shape is inserted into the porous copper sintered material 310 as the main body of the composite part.

Figure 11:
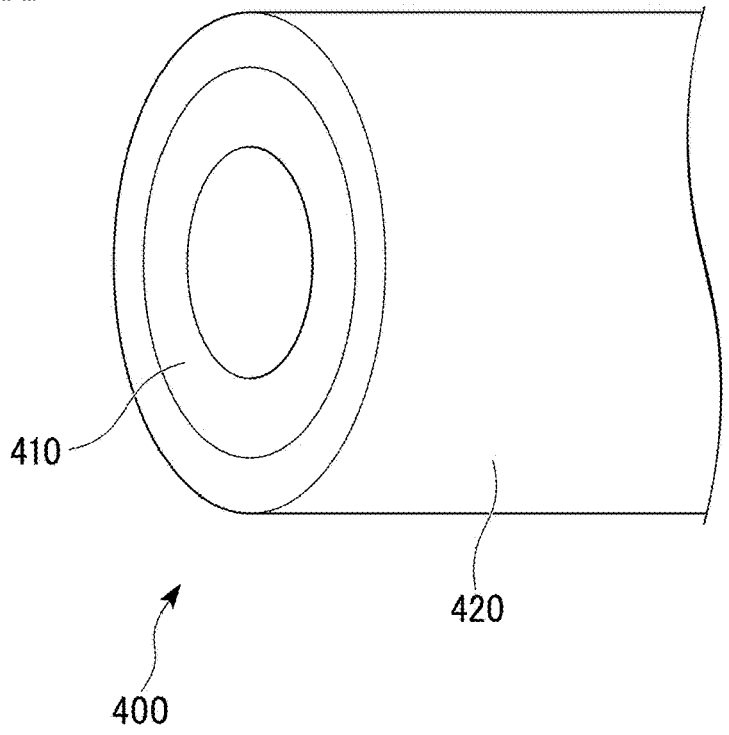
FIG. 11 is an external view of a porous copper composite part according to another embodiment of the present invention.

In addition, as shown in FIG. 11, the porous copper composite part may be the porous copper composite part 400 having the structure in which the porous copper sintered material 430 is joined to the inner circumferential surface of the copper tube 420, which is the main body of the composite part.

Figure 12:
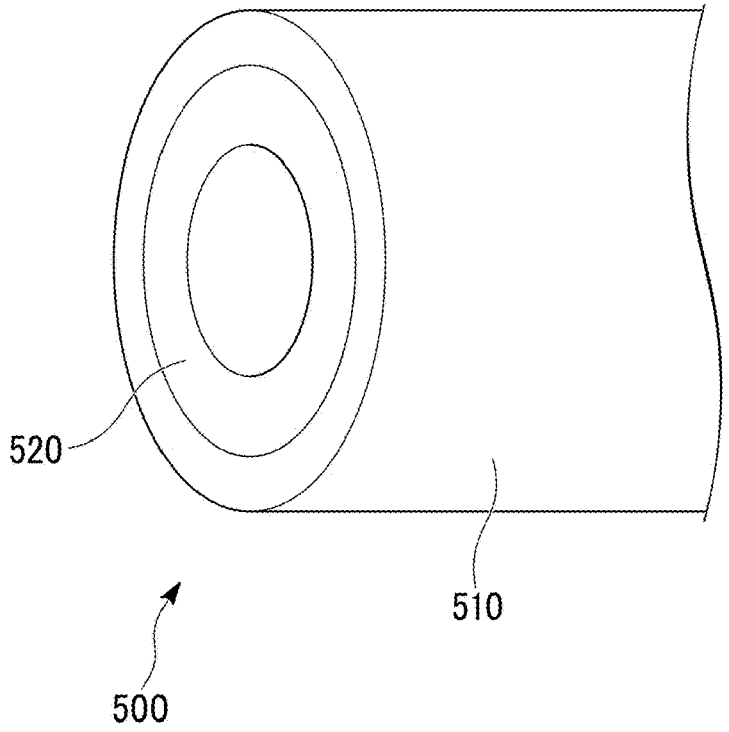
FIG. 12 is an external view of a porous copper composite part according to another embodiment of the present invention.

In addition, as shown in FIG. 12, the porous copper composite part may be the porous copper composite part 500 having the structure in which the porous copper sintered material 510 is joined to the outer circumferential surface of the copper tube 520, which is the main body of the composite part.

Figure 13:
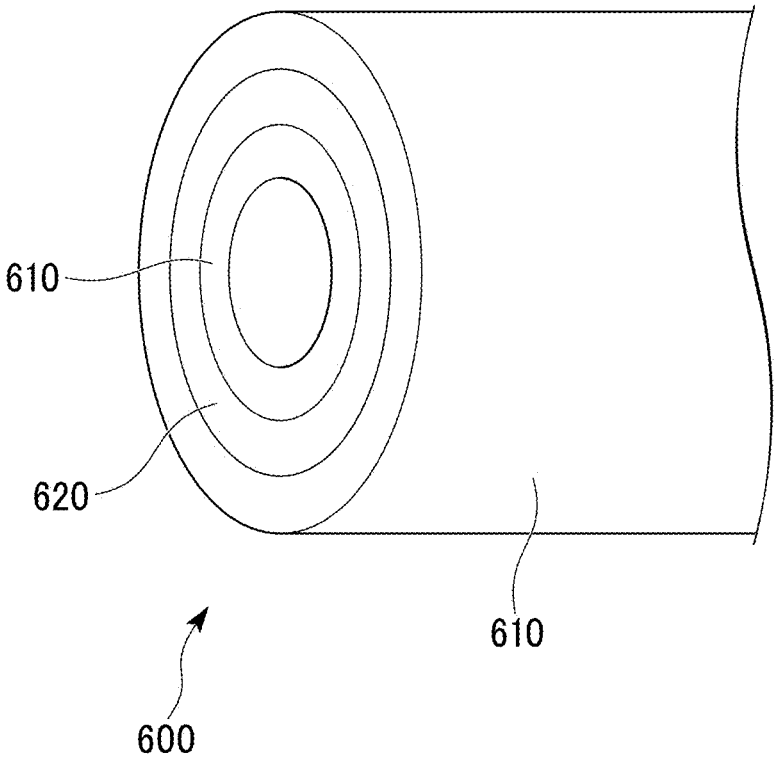
FIG. 13 is an external view of a porous copper composite part according to another embodiment of the present invention.

In addition, as shown in FIG. 13, the porous copper composite part may be the porous copper composite pat 600 having the structure in which the porous copper sintered materials 610 are joined to each of the inner and outer circumferential surfaces of the copper tube 620, which is the main body of the composite part.

Figure 14:
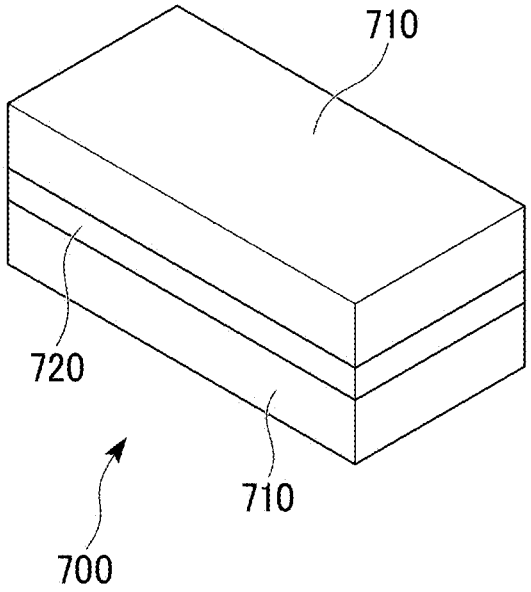
FIG. 14 is an external view of a porous copper composite part according to another embodiment of the present invention.

Alternatively, as shown in FIG. 14, the porous copper composite part may be the porous copper composite part 700 having the structure in which the porous copper sintered materials 710 are joined on both surfaces of the copper plate 720, which is the main body of the composite part.

EXAMPLES

Results of the tests for confirming the technical effect of the present invention are explained below.

The porous copper sintered materials having the dimension of: 30 mm of the width; 200 mm of the length; and 5 mm of the thickness, were produced by the production method shown in the above-described embodiment using the raw materials for sintering shown in Table 1. In Comparative Example 5, the oxidation treatment process was omitted, and the sintering step was performed only with the reduction treatment process.

Figure 15:
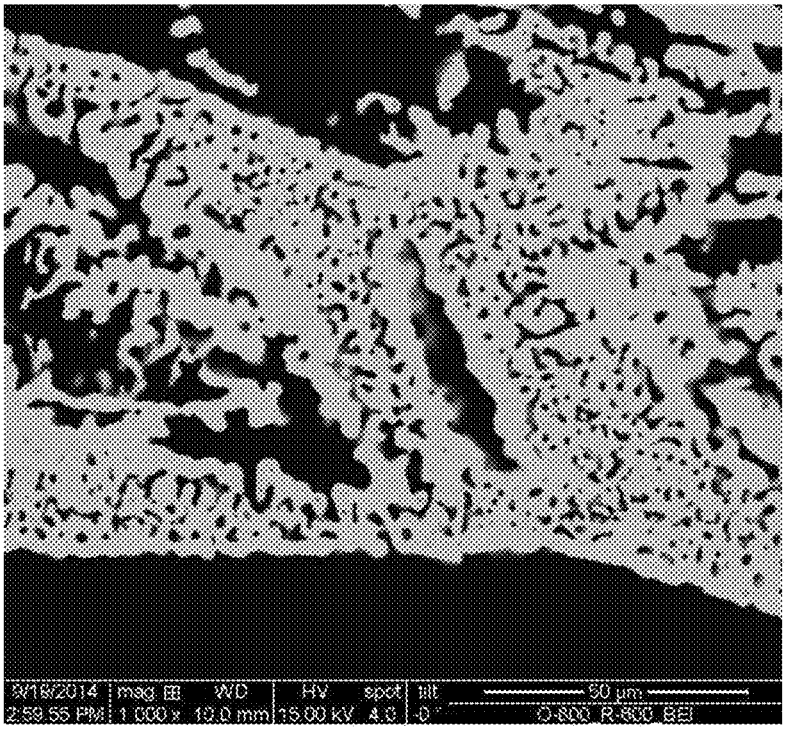
FIG. 15 is an enlarged observation photograph of the junction of the porous copper sintered material of Example 2 of the present invention.
Figure 16:
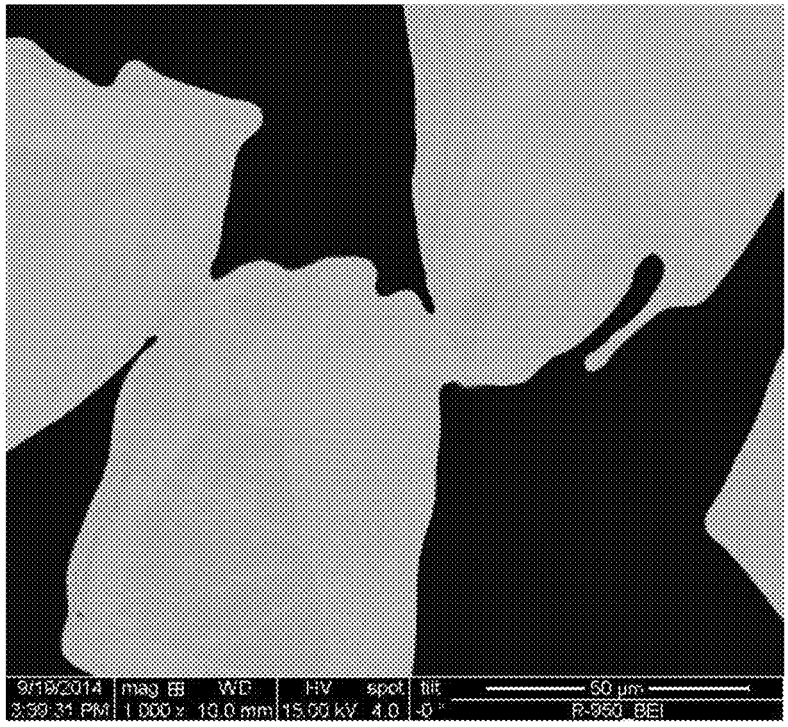
FIG. 16 is an enlarged observation photograph of the junction of the porous copper sintered material of Comparative Example 5.

Cross sections of the junctions of the obtained porous copper sintered materials were observed. Observation photograph in the porous copper sintered material of Example 2 of the present invention is shown in FIG. 15. Observation photograph in the porous copper sintered material of Comparative Example 5 is shown in FIG. 16.

In addition, the apparent density and the tensile strength were evaluated on the obtained porous copper sintered materials.

Results of the evaluations are shown in Table 1. The methods for evaluation are explained below.

[Apparent Density]

The apparent density $D_A$ of the obtained porous copper sintered materials was evaluated as the ratio to the true density $D_T$ of the copper fibers constituting the porous copper sintered materials.

[Tensile Strength]

After machining each of the obtained porous copper sintered materials into a test piece having the dimension of: 10 mm of the width; 100 mm of the length; and 5 mm of the thickness, the tensile test was performed with the Instron type tensile testing machine; and the maximum tensile strength (S) was measured. The maximum tensile strength (S) obtained in the above-described measurements varies based on the apparent density. Thus, in the present Examples, comparison was made based on the value $SND_A$, which was standardized by the maximum tensile strength (S) and the apparent density $D_A$, as the relative tensile strength defined.

TABLE 1

| | | Production condition | | | | | | | | | | Porous copper sintered material | |
|---|---|---|---|---|---|---|---|---|---|---|---|---|---|
| | | Copper fiber | | | | Oxidation treatment step | | | Reduction treatment step | | | | |
| | | Material | Diameter R (mm) | L/R | Bulk density*1 | Atmosphere | Temperature (° C.) | Time (min) | Atmosphere | Temperature (° C.) | Time (min) | Apparent density*2 | Tensile strength (N/mm²) |
| Examples of the present invention | 1 | C1100 | 0.02 | 1000 | 16 | Air | 530 | 280 | $N_2$—3% $H_2$ | 780 | 120 | 17 | 7.6 |
| | 2 | C1100 | 0.1 | 50 | 26 | Air | 700 | 60 | Ar—10% $H_2$ | 800 | 30 | 28 | 9.8 |
| | 3 | C1100 | 1 | 4 | 38 | Air | 1040 | 5 | $N_2$—3% $H_2$ | 600 | 300 | 42 | 6.7 |
| | 4 | C1100 | 0.05 | 2500 | 11 | Air | 700 | 60 | $N_2$—3% $H_2$ | 600 | 300 | 12 | 7.3 |
| | 5 | C1100 | 0.2 | 30 | 32 | Air | 650 | 100 | $N_2$—3% $H_2$ | 750 | 200 | 34 | 8.6 |
| | 6 | C1220 | 0.6 | 10 | 35 | Air | 980 | 10 | $N_2$—3% $H_2$ | 600 | 300 | 37 | 6.4 |

TABLE 1-continued

| | | Copper fiber | | | | Production condition | | | | | | Porous copper sintered material | |
|---|---|---|---|---|---|---|---|---|---|---|---|---|---|
| | | | | | | Oxidation treatment step | | | Reduction treatment step | | | | |
| | | Material | Diameter R (mm) | L/R | Bulk density*1 | Atmosphere | Temperature (° C.) | Time (min) | Atmosphere | Temperature (° C.) | Time (min) | Apparent density*2 | Tensile strength (N/mm$^2$) |
| | 7 | C1441 | 0.1 | 60 | 25 | Air | 850 | 30 | $N_2$—3% $H_2$ | 800 | 60 | 27 | 9.5 |
| | 8 | C1510 | 0.2 | 40 | 27 | Air | 700 | 60 | $N_2$—3% $H_2$ | 950 | 60 | 28 | 8.0 |
| | 9 | C2600 | 0.08 | 100 | 23 | Air | 700 | 60 | $N_2$—3% $H_2$ | 800 | 30 | 24 | 8.5 |
| | 10 | C7060 | 0.1 | 400 | 19 | Air | 600 | 200 | $N_2$—3% $H_2$ | 1070 | 5 | 24 | 9.7 |
| Comparative Examples | 1 | C1100 | 0.01 | 1000 | 25 | Air | 700 | 60 | Ar—10% $H_2$ | 800 | 30 | 26 | 4.5 |
| | 2 | C1100 | 1.3 | 5 | 43 | Air | 700 | 60 | Ar—10% $H_2$ | 800 | 30 | 43 | 4.2 |
| | 3 | C1100 | 1 | 2 | 60 | Air | 700 | 60 | $N_2$—3% $H_2$ | 800 | 30 | 70 | 5.5 |
| | 4 | C1100 | 0.05 | 3500 | 16 | Air | 700 | 60 | $N_2$—3% $H_2$ | 800 | 30 | 17 | 4.2 |
| | 5 | C1100 | 0.1 | 50 | 34 | — | — | — | $N_2$—3% $H_2$ | 950 | 30 | 36 | 2.8 |

*1The bulk density $D_P$ was the ratio (%) to the true density $D_T$ of the copper fibers.
*2The apparent density $D_A$ was the ratio (%) to the true density $D_T$ of the copper fibers.

According to the results of the cross section observation on the junctions of the porous copper sintered materials produced in Examples of the present invention, it was demonstrated that each of the redox layers formed on the copper fibers were integrally bonded in the junctions between each of the copper fibers in the pours copper sintered material of Example 2 of the present invention shown in FIG. 15. In addition, fine concavities and convexities were formed by the redox layers; and it was confirmed that these concavities and convexities were integrally bonded being intricately intertwined with each other.

Contrary to that, in the porous copper sintered material of Comparative Example 5, in which the oxidation treatment was not performed, shown in FIG. 16, the copper fibers were bonded through limited parts of the copper fibers; and it was confirmed that the joining area in the junction was extremely small compared to the Example of the present invention. In other words, when only the reduction treatment was performed, the redox layers were not formed on the surface of the copper fibers; and the surface condition were kept in the relatively flat (smooth) surface unchanged from the state before the treatment. Because of this, the joining area between each of the copper fibers was not secured sufficiently.

In addition, it was confirmed that the tensile strength of the porous copper sintered material was low in Comparative Examples 1, in which the diameter R of the copper fibers was set to 0.01 mm, and Comparative Example2, in which the diameter R of the copper fibers was set to 1.3 mm, as shown in Table 1.

In addition, the bulk density $D_P$ was 60% of the true density $D_T$ of the copper fibers; and the apparent density $D_A$ after sintering was 70% of the true density $D_T$ of the copper fibers in Comparative Example 3, in which the ratio L/R of the length L of the copper fibers to the diameter R was set to 2. Thus, a high porosity could not be secured.

In addition, the strength was low in Comparative Example 4, in which the ratio L/R of the length L of the copper fibers to the diameter R was set to 3500. It was interpreted that there was a part having a larger space locally; and the strength was significantly reduced at the location.

In addition, it was confirmed that the tensile strength of the porous copper sintered material was low in Comparative Example 5, in which sintering was performed with the reduction treatment alone free of the oxidation treatment.

Contrary to that, in the porous copper sintered material of Examples of the present invention, the apparent density $D_A$ after sintering did not change significantly compared to the bulk density $D_P$ during laminating the copper fibers; and it was confirmed that the shrinkage in sintering was suppressed. In addition, the tensile strength was high, and it was confirmed that each of the copper fibers was bonded strongly.

Based on the results explained above, it was confirmed that the high quality porous copper sintered material having a high porosity and a sufficient strength could be provided according to the present invention.

INDUSTRIAL APPLICABILITY

A porous copper sintered material and a porous copper composite part having a high dimensional accuracy and strength are provided. For example, they can be applied to an electrode and a current collector of various batteries; a part of heat exchangers; a sound-deadening part; a filter; a shock absorbing part; or the like.

REFERENCE SIGNS LIST

10, 110: Porous copper sintered material
11: Copper fiber
12: Redox layer
100: Porous copper composite part
120: Copper plate (main part of the composite part)
A: Air atmosphere
B: Mixed gas atmosphere of nitrogen and hydrogen

What is claimed is:

1. A porous copper sintered material comprising a plurality of copper fibers sintered to each other, wherein the copper fibers are made of copper or copper alloy, a diameter R of the copper fibers is in a range of 0.05 mm or more and 1.0 mm or less, and a ratio L/R of a length L of the copper fibers to the diameter R is in a range of 4 or more and 2500 or less, redox layers formed by redox treatment are provided on surfaces of the copper fibers, and concavities and convexities are formed by the redox layer, each of the redox layers formed on each of the copper fibers is integrally bonded in a junction of the copper fibers, and a core portion which is not oxidized and reduced remains in at least one of the copper fibers.

2. A porous copper composite part comprising a main body and the porous copper sintered material according to claim 1, wherein the main body of the composite part and the porous copper sintered material are joined.

3. The porous copper composite part according to claim 2, wherein among the main body of the composite part, a joining surface of the main body of the composite part joined to the porous copper sintered material is constituted of copper or copper alloy, a redox layer formed by redox treatment is provided on the joining surface of the main body of the composite part, and the redox layer formed on the surfaces of the copper fibers and the redox layer formed on the joining surface of the main body of the composite part are integrally bonded in junctions between the copper fibers constituting the porous copper sintered material and the joining surface of the main body of the composite part.

* * * * *